US007036900B2

(12) United States Patent
Vanhooydonck et al.

(10) Patent No.: US 7,036,900 B2
(45) Date of Patent: May 2, 2006

(54) PRINTING METHOD AND APPARATUS FOR BACK-UP OF DEFECTIVE MARKING ELEMENTS

(75) Inventors: Rudi Vanhooydonck, Zwijndrecht (BE); Patrick Van den Bergen, Hove (BE)

(73) Assignee: Agfa Gevaert, Mortsel (BE)

( * ) Notice: Subject to any disclaimer, the term of this patent is extended or adjusted under 35 U.S.C. 154(b) by 0 days.

(21) Appl. No.: 10/375,541

(22) Filed: Feb. 27, 2003

(65) Prior Publication Data

US 2003/0174182 A1 Sep. 18, 2003

Related U.S. Application Data

(60) Provisional application No. 60/368,312, filed on Mar. 28, 2002.

(30) Foreign Application Priority Data

Mar. 15, 2002 (EP) ..... 02100264

(51) Int. Cl.
*B41J 29/38* (2006.01)
*B41J 29/393* (2006.01)

(52) U.S. Cl. ..... 347/12; 347/19

(58) Field of Classification Search ..... 347/23
See application file for complete search history.

(56) References Cited

U.S. PATENT DOCUMENTS

| | | | | |
|---|---|---|---|---|
| 5,124,720 A * | 6/1992 | Schantz | ..... | 347/19 |
| 6,010,205 A | 1/2000 | Billet | ..... | 347/19 |
| 6,203,140 B1 * | 3/2001 | Oyen | ..... | 347/41 |
| 6,354,689 B1 | 3/2002 | Couwenhoven et al. | ..... | 347/19 |
| 6,481,816 B1 * | 11/2002 | Oyen | ..... | 347/12 |
| 6,533,380 B1 * | 3/2003 | Hadimioglu et al. | ..... | 347/12 |
| 6,565,180 B1 * | 5/2003 | Yu et al. | ..... | 347/19 |
| 2001/0003458 A1 * | 6/2001 | Shioya | ..... | 347/19 |

FOREIGN PATENT DOCUMENTS

| | | | | |
|---|---|---|---|---|
| EP | 0 863 004 A2 | 9/1998 | ..... | 347/19 |
| EP | 1 085 457 A1 | 3/2001 | | |
| EP | 02 10 0264 | 8/2002 | | |
| WO | WO 99/08875 | 2/1999 | ..... | 347/19 |

* cited by examiner

*Primary Examiner*—K. Feggins
*Assistant Examiner*—Julian D. Huffman
(74) *Attorney, Agent, or Firm*—John A. Merecki; Robert A. Sabourin

(57) ABSTRACT

A dot matrix printer and printing method for being able to print a dot matrix on a printing medium using a plurality of marking elements on a printing head is described. A set of combinations of firing order of the plurality of marking elements is determined as well as a sequence of relative translation movements between the printing medium and the printing head so that all the dots in the dot matrix can be printed by application of each of the set of combinations, and any dot in the dot matrix can be printed by at least a first and a second equivalent marking element from a set of equivalent marking elements. For printing sets of dots in the dot matrix, a first equivalent marking element is selected from the set of equivalent marking elements to print the set of dots as part of a first firing order. If a pre-set number of equivalent marking elements of the set of equivalent marking elements are defective, the printing head is reconfigured so that other sets of at least first and second equivalent marking elements are determined.

19 Claims, 11 Drawing Sheets

PRINTING METHOD AND APPARATUS FOR BACK-UP OF DEFECTIVE MARKING ELEMENTS

The application claims the priority of provisional U.S. patent application No. 60/368,312 filed Mar. 28, 2002.

FIELD OF THE INVENTION

The present invention relates to a method and an apparatus for printing, such as ink jet or thermal transfer printing, especially non-contact printing as well as to a control unit suitable for controlling such a printer.

BACKGROUND OF THE INVENTION

Printing is one of the most popular ways of conveying information to members of the general public. Digital printing using dot matrix is printers allows rapid printing of text and graphics stored on computing devices such as personal computers. These printing methods allow rapid conversion of ideas and concepts to a printed product at an economic price without time consuming and specialised production of intermediate printing plates such as lithographic plates. The development of digital printing methods has made printing an economic reality for the average person even in the home environment.

Conventional methods of dot matrix printing often involve the use of a printing head, e.g. an ink jet printing head, with a plurality of marking elements, e.g. ink jet nozzles. The marking elements transfer a marking material, e.g. ink or resin, from the printing head to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme, (e.g. CMYK plus one or more additional spot or specialised colours). To print a printing medium such as paper or plastic, the marking elements are used or "fired" in a specific order while the printing medium is moved relative to the printing head. Each time a marking element is fired, marking material, e.g. ink, is transferred to the printing medium by a method depending on the printing technology used. Typically, in one form of printing, the head will be moved relative to the printing medium to produce a so-called raster line which extends in a first direction, e.g. across a page. The first direction is sometimes called the "fast scan" direction. A raster line comprises a series of dots delivered onto the printing medium by the marking elements of the printing head. The printing medium is moved, usually intermittently, in a second direction perpendicular to the first direction. The second direction is often called the slow scan direction.

The combination of printing raster lines and moving the printing medium relative to the printing head results in a series of parallel raster lines, which are usually closely spaced. Seen from a distance, the human eye perceives a complete image and does not resolve the image into individual dots provided these dots are close enough together. Closely spaced dots of different colours are not distinguishable individually but give the impression of colours determined by the amount or intensity of the three colours cyan, magenta and yellow which have been applied.

In order to improve the veracity of printing, e.g. of a straight line, it is preferred that the distance between dots of the dot matrix is small, that is the printing has a high resolution. Although it cannot be said that high resolution always means good printing, it is true that a minimum resolution is necessary for high quality printing. A small dot spacing in the slow scan direction means a small distance between marker elements on the head, whereas regularly spaced dots at a small distance in the fast scan direction places constraints on the quality of the drives used to move the printing head relative to the printing medium in the fast scan direction.

Generally, there is a mechanism for positioning a marker element in a proper location over the printing medium before it is fired. Usually, such a drive mechanism is controlled by a microprocessor, a programmable digital device such as a PAL, a PLA, a FPGA or a similar device although the skilled person will appreciate that anything controlled by software can also be controlled by dedicated hardware and that software is only one implementation strategy.

One general problem of dot matrix printing is the formation of artefacts caused by the digital nature of the image representation and the use of equally spaced dots. Certain artefacts such as Moiré patterns may be generated due to the fact that the printing attempts to portray a continuous image by a matrix or pattern of (almost) equally spaced dots. One source of artefacts can be errors in the placing of dots caused by a variety of manufacturing defects such as the location of the marker elements in the head or systematic errors in the movement of the printing head relative to the printing medium. In particular, if one marking element is misplaced or its firing direction deviates from the intended direction, the resulting printing will show a defect which can run throughout the printing. A variation in drop velocity will also cause artefacts when the printing head is moving, as time of flight of the drop will vary with variation in the velocity. Similarly, a systematic error in the way the printing medium is moved relative to the printing medium may result in defects that may be visible. For example, slip between the drive for the printing medium and the printing medium itself will introduce errors. In fact, any geometrical limitation of the printing system can be a source of errors, e.g. the length of the printing head, the spacing between marking elements, the indexing distance of the printing medium relative to the head in the slow scan direction. Such errors may result in "banding" that is the distinct impression that the printing has been applied in a series of bands. The errors involved can be very small—the colour discrimination, resolution and pattern recognition of the human eye are so well developed that it takes remarkably little for errors to become visible.

To alleviate some of these errors it is known to alternate or vary the use of marking elements so as to spread errors throughout the printing so that at least some systematic errors will then be disguised. For example, one method often called "shingling" is known from U.S. Pat. No. 4,967,203, which describes an ink jet printer and method. Each printing location or "pixel" can be printed by four dots, one each for cyan, magenta, yellow and black. Adjacent pixels on a raster line are not printed by the same marking element in the printing head. Instead, every other pixel is printed using the same marking element. In the known system the pixels are printed in a checkerboard pattern, that is, as the head traverses in the fast scan direction a marking element is able to print at only every other pixel location. Thus, any marking element that prints consistently in error does not result in a line of pixels in the slow scan direction, each of which has the same error. However the result is that only 50% of the marking elements in the head can print at any one time. In fact, in practice, each marking element prints at a location that deviates a certain amount from the correct position for this marking element. The use of shingling can distribute these errors through the printing. It is generally accepted that shingling is an inefficient method of printing as not all the marking elements are used continuously and several passes are necessary.

As said above, this kind of printing has been called "shingling". However, printing dictionaries refer to "shingling" as a method to compensate for creep in book-making. The inventors are not aware of any industrially accepted term for the printing method wherein no adjacent pixels on a raster line are printed by one and the same marking element. Therefore, from here on and in what follows, the terms "mutually interstitial printing" or "interstitial mutually interspersed printing" are used. It is meant by these terms that an image to be printed is split up in a set of sub-images, each sub-image comprising printed parts and spaces, and wherein at least a part of the spaces in one printed sub-image form a location for the printed parts of another sub-image, and vice versa.

Another method of printing is known as "interlacing", e.g. as described in U.S. Pat. No. 4,198,642. The purpose of this type of printing is to increase the resolution of the printing device. That is, although the spacing between marking elements on the printing head along the slow scan direction is a certain distance X, the distance between printed dots in the slow scan direction is less than this distance. The relative movement between the printing medium and the printing head is indexed by a distance given by the distance X divided by an integer.

There is a continuous requirement for improvements in printing quality. In particular, there is a requirement that dots forming the images are properly placed and of uniform size, and wherein the method of formation of the dots is resistant to degradation with extended use of the print head.

It is known from U.S. Pat. No. 4,963,882 to use an ink jet printer that tries to solve the above problem. The solution described uses a double dotting approach, whereby each dot is formed from at least two droplets of each colour, ejected from different marking elements. It is a disadvantage of the solution described that, if in a print head a marking element breaks down, and it happens to be a marking element which compensates for a marking element which prints badly (e.g. with a deviation between the desired printing location and the actual printing location), then either the error becomes visible and image quality is deteriorated, or the print head has to be replaced. If two marking elements are defect, which are exactly the marking elements which should be printing on the same dot location, then a blank printing result is obtained, and in that case the print head should definitely be replaced.

U.S. Pat. No. 6,126,341 describes a print head with a plurality of printing marking elements. When one of the plurality of marking elements is defective, a control device reads out the image data for the defective marking element from a first image data storing device, and saves the readout image data into a second image data storing device. After a swath has been printed by the normal marking elements, while the defective marking element is not driven, a substitution marking element is selected from among the normal marking elements or from a set of substitution marking elements, and is caused to print on a location on the sheet which would otherwise be subjected to printing by the defective marking element, in accordance with the image data read out from the second image data storing device. Therefore an extra printing pass is needed in order to back-up the defect marking element, and thus printing slows down. It is an object of the present invention to provide a printing method and apparatus which provide high resolution printing at high speed with a reduced visible effect of errors.

SUMMARY OF THE INVENTION

This object is accomplished by a dot matrix printing method for being able to print a dot matrix on a printing medium using a plurality of marking elements on a printing head, comprising the steps of:

determining a set of combinations of firing order of the plurality of marking elements and a sequence of relative translation movements between the printing medium and the printing head so that all the dots in the dot matrix can be printed by application of each of the set of combinations, and any dot in the dot matrix can be printed by at least a first and a second equivalent marking element from a set of equivalent marking elements, selecting, for printing sets of dots in the dot matrix, a first equivalent marking element from the set of equivalent marking elements to print the set of dots as part of a first firing order, and if a pre-set number of equivalent marking elements of the set of equivalent marking elements are defective, reconfiguring the printing head so that other sets of at least first and second equivalent marking elements are determined. This pre-set number may include all equivalent marking elements of the set of equivalent marking elements, or less.

Preferably, the first or second equivalent marking elements are fired as part of a mutually interstitial printing scheme. The set of equivalent marking elements may be optimised, i.e. the selecting step may be based on the criterion of which of the at least two equivalent marking elements gives the best printing results.

According to a first embodiment, the selecting step is based on misalignment of the marking elements. For example, if misalignment is below a threshold for all equivalent marking elements of a set, the equivalent marking elements may be fired alternatingly. If misalignment is below a threshold for a first number of equivalent marking elements, and above that threshold for the other equivalent marking elements, then the first number of marking elements may be fired alternatingly. If misalignment for a first number of equivalent marking elements is in one direction, and misalignment of the other equivalent marking elements of the same set is in the opposite direction, then for each direction the equivalent marking element with the lowest misalignment value may be determined, and these equivalent marking elements may be fired alternatingly. If nozzle misalignment is in the same direction for all equivalent marking elements, the marking element with the lowest misalignment value may always be fired.

According to another embodiment, the selecting step is based on interdot distance of dots printed by the marking elements. For example an equivalent marking element may not be used if the distance of a dot printed by this marking element to its neighbouring dots is larger than a predetermined threshold. The reconfiguration step may be done in software.

According to the present invention, the printing times for printing by means of the first equivalent marking element or by means of the second equivalent marking element are the same.

The present invention also provides an apparatus for dot matrix printing an image on a printing medium. The apparatus comprises:

- a printing head,
- a plurality of equally spaced marking elements on the printing head,
- a determination device to determine a set of combinations of firing order of the plurality of equally spaced marking elements and a sequence of relative translation movements between the printing head and the printing medium so that all dots in the dot matrix can be printed by application of each of the set of combinations, and any dot in the matrix can be printed by at least two equivalent marking elements of a set of equivalent marking elements,
- a selecting device for selecting, for printing sets of dots in the dot matrix, a first equivalent marking element of the set of equivalent marking elements to print the set of dots as a part of a first firing order, and
- a reconfiguration device for reconfiguring the printing head if a pre-set number of equivalent marking elements of the set of equivalent marking elements are defect, so that other sets of at least first and second equivalent marking elements are determined by the determination device. The pre-set number of equivalent marking elements may be all the equivalent marking elements in a set, or less.

The marking elements may be ink projecting nozzles. The reconfiguration device may be implemented in software. The apparatus of the present invention may be adapted so that printing times for printing by means of the first equivalent marking element or by means of the second equivalent marking element are the same.

The present invention furthermore provides an ink jet printing device including an apparatus as described according to the present invention.

The present invention also includes a computer program product for executing any of the methods of the present invention when executed on a computing device associated with a printing head. A machine readable data storage device may store the computer program product. The present invention also includes a control unit for a printer for printing an image on a printing medium using a print head having a plurality of equally spaced marking elements. The control unit is adapted to control the determination of a set of combinations of firing order of the plurality of equally spaced marking elements and a sequence of relative translation movements between the printing head and the printing medium so that all dots in a dot matrix can be printed by application of each of the set of combinations, and any dot in the matrix can be printed by at least two equivalent marking elements of a set of equivalent marking elements. The control unit is also adapted to control the selection, in order to print sets of dots in the dot matrix, of a first equivalent marking element of the set of equivalent marking elements to print the set of dots as a part of a first firing order, and to control the reconfiguration of the printing head if a pre-set number of equivalent marking elements of the set of equivalent marking elements are defect, so that other sets of at least first and second equivalent marking elements are determined.

The present invention will now be described with reference to the following schematic drawings.

DETAILED DESCRIPTION OF THE INVENTION

Figure 1:
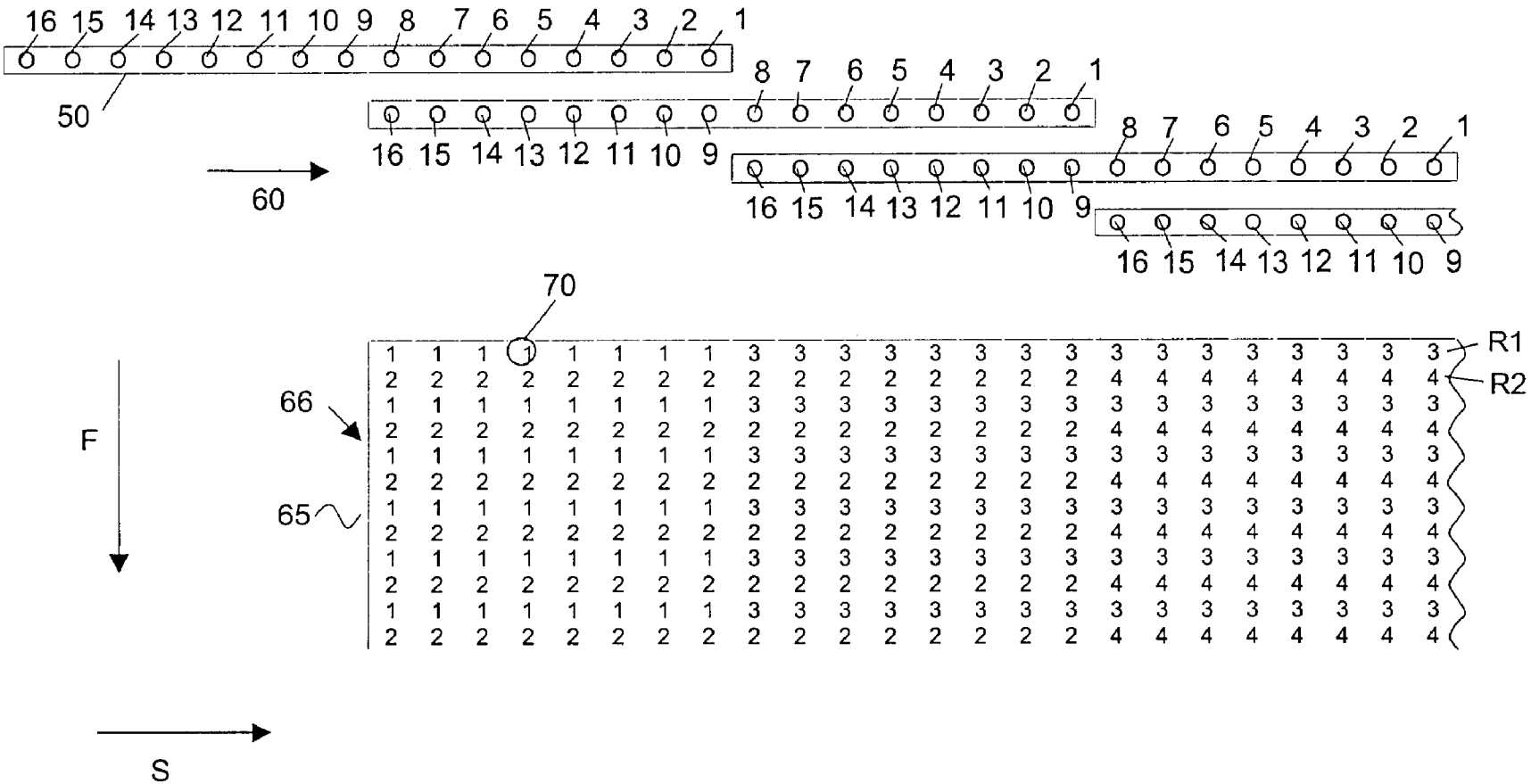
FIG. 1 shows an embodiment of a printing head with 16 marking elements used for 50% mutually interstitial printing, such that there is a marking element redundancy of two.

The present invention will be described with reference to certain embodiments and drawings but the present invention is not limited thereto but only by the claims. The present invention will be described with reference mainly to ink-jet printing but the present invention is not limited thereto. The term "printing" as used in this invention should be construed broadly. It relates to forming markings whether by ink or other materials or methods onto a printing substrate. Various printing methods which may be used with the present invention are described in the book "Principles of non-impact printing", J. L. Johnson, Palatino Press, Irvine, 1998, e.g. thermal transfer printing, thermal dye transfer printing, deflected ink jet printing, ion projection printing, field control printing, impulse ink jet printing, drop-on-demand ink jet printing, continuous ink jet printing. Non-contact printing methods are particularly preferred. However, the present invention is not limited thereto. Any form of printing including dots or droplets on a substrate is included within the scope of the present invention, e.g. piezoelectric printing heads may be used to print polymer materials as used and described by Plastic Logic (http://plasticlogic.com/) for the printing of thin film transistors. Hence, the term "printing" in accordance with the present invention not only includes marking with conventional staining inks but also the formation of printed structures or areas of different characteristics on a substrate. One example is the printing of water repellent or water attractive regions on a substrate in order to form an off-set printing plate by printing. Accordingly, the term "printing medium" or "printing substrate" should also be given a wide meaning including not only paper, transparent sheets, textiles but also flat plates or curved plates which may be included in or be part of a printing press. In addition the printing may be carried out at room temperature or at elevated temperature, e.g. to print a hot-melt adhesive the printing head may be heated above the melting temperature. Accordingly, the term "ink" should also be interpreted broadly including not only conventional inks but also solid materials such as polymers which may be printed in solution or by lowering their viscosity at high temperatures as well as materials which provide some characteristic to a printed substrate such as information defined by a structure on the surface of the printing substrate, water repellance, or binding molecules such as DNA which are spotted onto microarrays. As solvents both water and organic solvents may be used. Inks as used with the present invention may include a variety of additives such as antoxidants, pigments and cross-linking agents.

According to embodiments of the present invention, a mutually interstitial printing scheme is preferably applied to the image to be printed. This means that every pixel location can be reached by at least two different marking elements.

First the concept of mutually interstitial printing or mutually interspersed printing will be explained as applied to a traversing or scanning head 50 for printing one colour only (e.g. a black head). FIG. 1 shows how an image is divided in sub-images, which are mutually interstitially printed by 50%. When looking at FIG. 1 it would appear that the head 50 is displaced in a slow scan direction S with respect to a printing medium 66. This in fact refers to relative motion between the two and the typical implementation is that the printing medium 66 is transported a distance relative to the head 50, e.g. a half of a head length, in the opposite direction to that shown in FIG. 1 (i.e. in the −S direction). In the following, it is preferred to refer to the transport of the head 50 because a pixel position on the printing medium is the reference. In a first pass, marking elements 1-8 in a first fraction, e.g. a first half of the head 50 print every so many pixels, e.g. every second pixel in a column in the fast scan direction F, beginning with the first row R1 which is able to print. Locations where the print head 50 prints during the first pass are indicated by a 1 in the matrix 65 of FIG. 1. It is to be noted that whether or not a marking element actually print depends on the image to be printed, i.e. whether or not a dot is to be printed at a certain location in the matrix 65. Thus, a 1 in the matrix 65 indicates the ability of the relevant marking element to print at that location during the first pass—it does not mean that it always prints at this location. Also, going down a "column" of the matrices in the attached figures refers to going along the fast scan direction F, i.e. the direction perpendicular to the longitudinal axis 60 of the printing head 50.

After the first scan across the printing medium is complete, the head 50 is returned to the starting position and is transported a half of its length with respect to the printing medium in the slow scan direction (S) ready for pass 2. This means that the head 50 is transported relative to the printing medium 66 by an exact fraction of the head length, e.g. an exact number of nozzle pitches between the firing positions of the relevant marking elements. In the above embodiment it is assumed that the head 50 does not print on the return trip but printing in both fast scan directions F and −F is included within the scope of the present invention. From now on the printer is printing with all marking elements 1–16 every second pixel. In the second pass the head 50 is printing every second pixel, beginning with the second row R2 in the matrix 65 (indicated by a 2 in the matrix 65). Again, a 2 in the matrix 65 indicates the ability of the relevant marking element to print at that location during the second pass—it does not mean that it always prints at this location. After the second pass is complete the print head 50 is displaced a half of its length again. In the third pass the head 50 is printing every odd pixel, again beginning with the first row R1 in the matrix 65 (indicated by 3). The print head 50 is transported a half of its length again in the slow scan direction S, and the fourth pass (number 4) is printed every second row beginning with row R2. Such cycles comprising moving the head 50 over half its length, starting to print at the first row R1, moving the head 50 over half its length and starting to print at the second row R2, are repeated continuously.

The result of this is that a dot in a column (i.e. in the fast scan direction F) is only printed with the same marking element every two pixels. Each adjacent dot in the F direction is printed by a different marking element.

The cycle repeats every two passes—this is 50% mutually interstitial printing. Because in each column each two successive dots are each printed with a different marking element, banding problems due to misalignment of marking elements are hidden. The cycle could also repeat for example every four passes, which then is 25% mutually interstitial printing.

As can be seen in FIG. 1, at 50% mutually interstitial printing there is a redundancy of 2, i.e. each pixel location can be reached by two marking elements. For example pixel location 70 is printed by marking element 5 during the first pass. During the second pass, however, marking element 13 passes over pixel location 70 without being fired there. Therefore, marking elements 5 and 13 are a redundant pair of marking elements. The same goes for all marking elements of the head 50: they all form a redundant pair of marking elements with another marking element of the head 50. Redundant pairs of marking elements are (1, 9), (2, 10), (3, 11), (4, 12), (5, 13), (6, 14), (7, 15), (8, 16).

Figure 2:
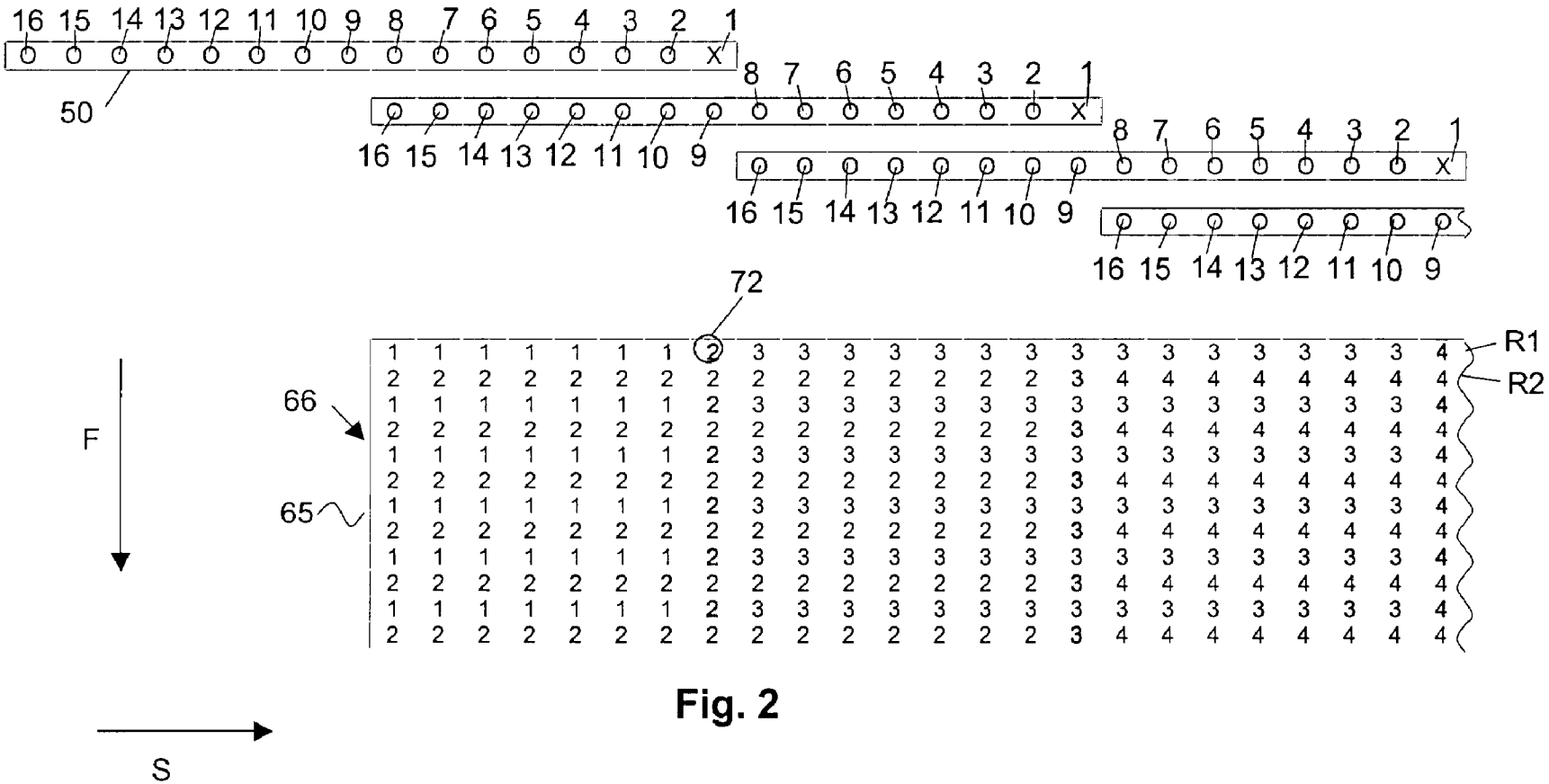
FIG. 2 illustrates the same embodiment as in FIG. 1, but with a defective marking element 1.

If one of the marking elements of the head 50 is defect (does not print or dots are not properly placed), for example marking element 1 as shown in FIG. 2, its function can be taken over by the marking element which forms a redundant pair of marking elements with the defective marking element. So, in FIG. 2 it is shown that marking element 1 is defect, and in the example given its function can be taken over by marking element 9 then. This means that during a first pass, marking elements 2–8 print on pixel location of an odd row, starting at row R1, as noted by 1 in the matrix 65. During the second pass of the head 50, on the odd rows, marking element 9 prints where marking element 1 did not print because of its defect, and on the even rows, starting with row R2, marking elements 2–16 print on locations noted with 2 in the matrix 65. If also other marking elements are defect, the corresponding marking elements from the redundant pairs of marking elements take over their function. During a third pass of the head 50, on the odd rows, marking elements 2–16 print where necessary according to the image to be printed, and on the even rows, marking element 9 prints where marking element 1 did not print during the second pass due to its defect. This continues over the whole matrix 65.

Figure 3:
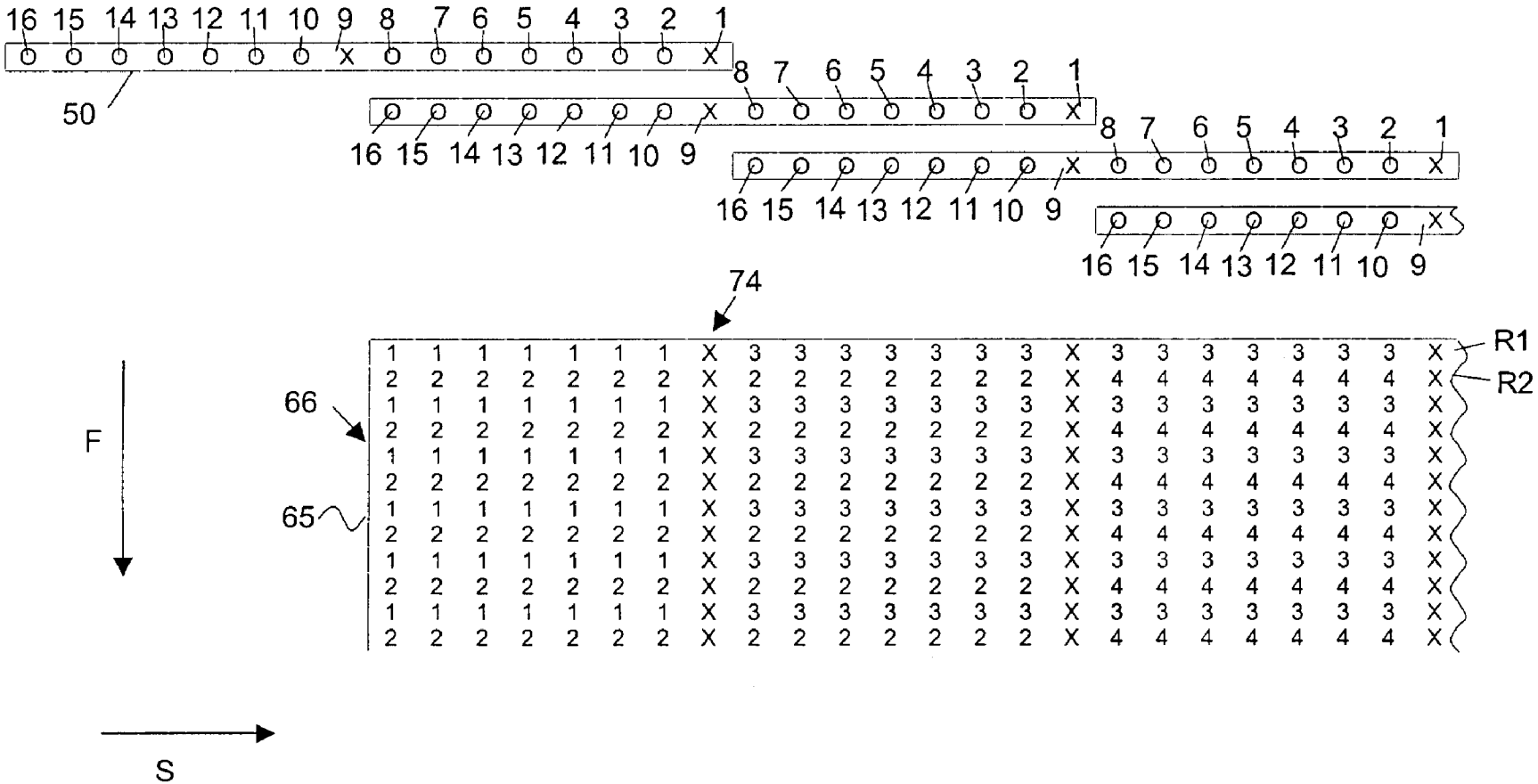
FIG. 3 illustrates the same embodiment as in FIG. 1, but with defective marking elements 1 and 9.

The above method can be carried out as long as for each redundant pair of marking elements, at least one marking element is functioning. If, however, as shown in FIG. 3, marking elements 1 and 9 are defect, which form a redundant pair of marking elements, then nothing would be printed on column 74. In order to solve this, the print head 50 has to be reconfigured. Instead of 16 active marking elements, only 14 active marking elements are left.

Figure 4A:
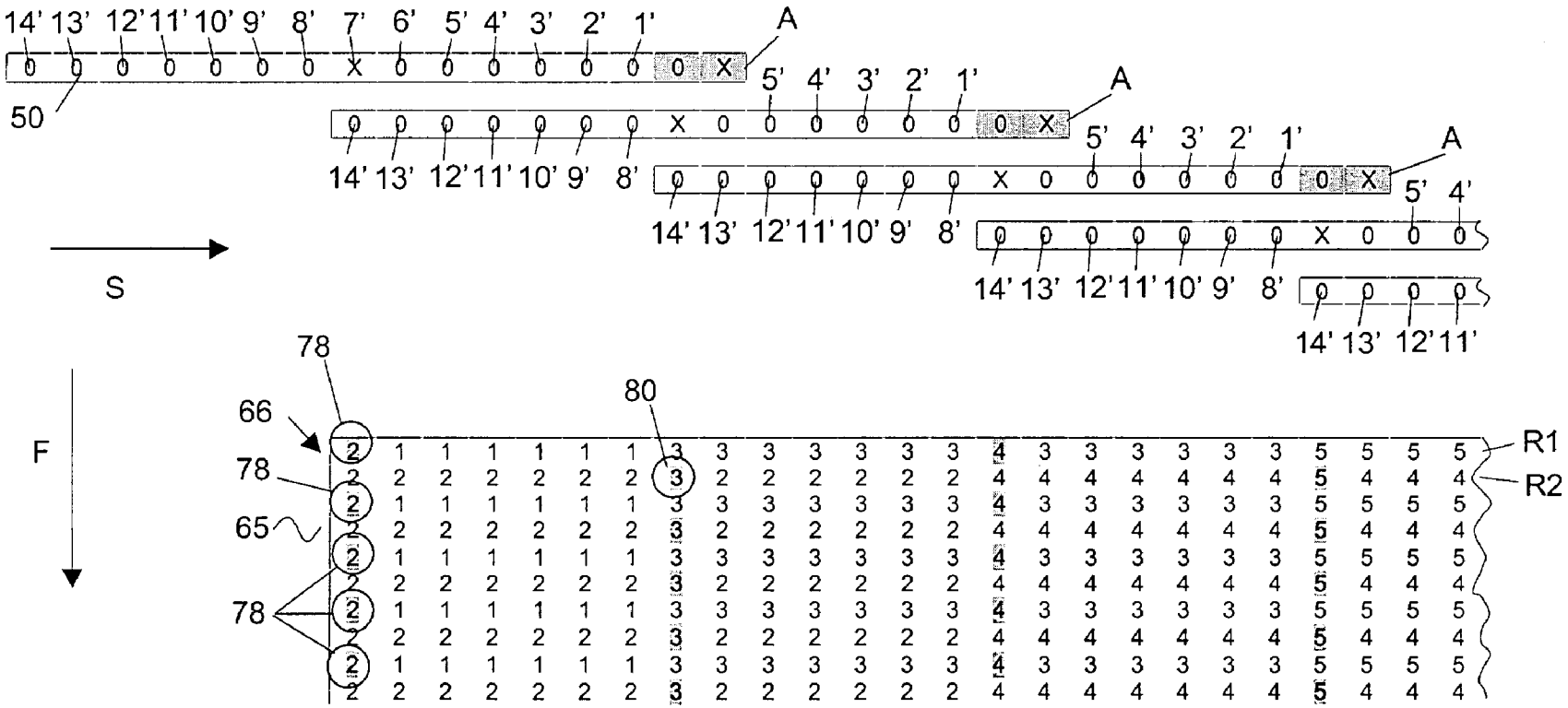
FIG. 4A illustrates the same embodiment as in FIG. 3, with the head being reconfigured according to a first embodiment so as to again have marking element redundancy of two as in FIG. 1.
Figure 4B:
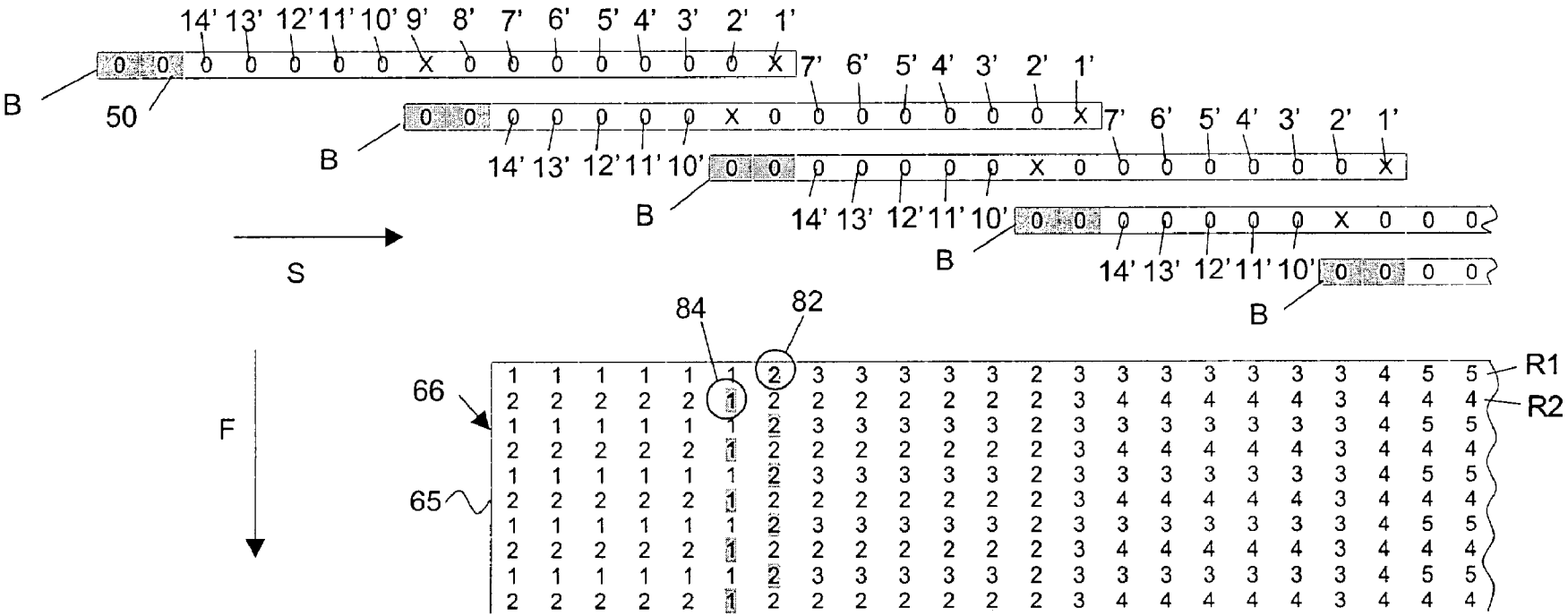
FIG. 4B illustrates the same embodiment as in FIG. 3, with the head being reconfigured according to a second embodiment so as to again have marking element redundancy of two as in FIG. 1.
Figure 4C:
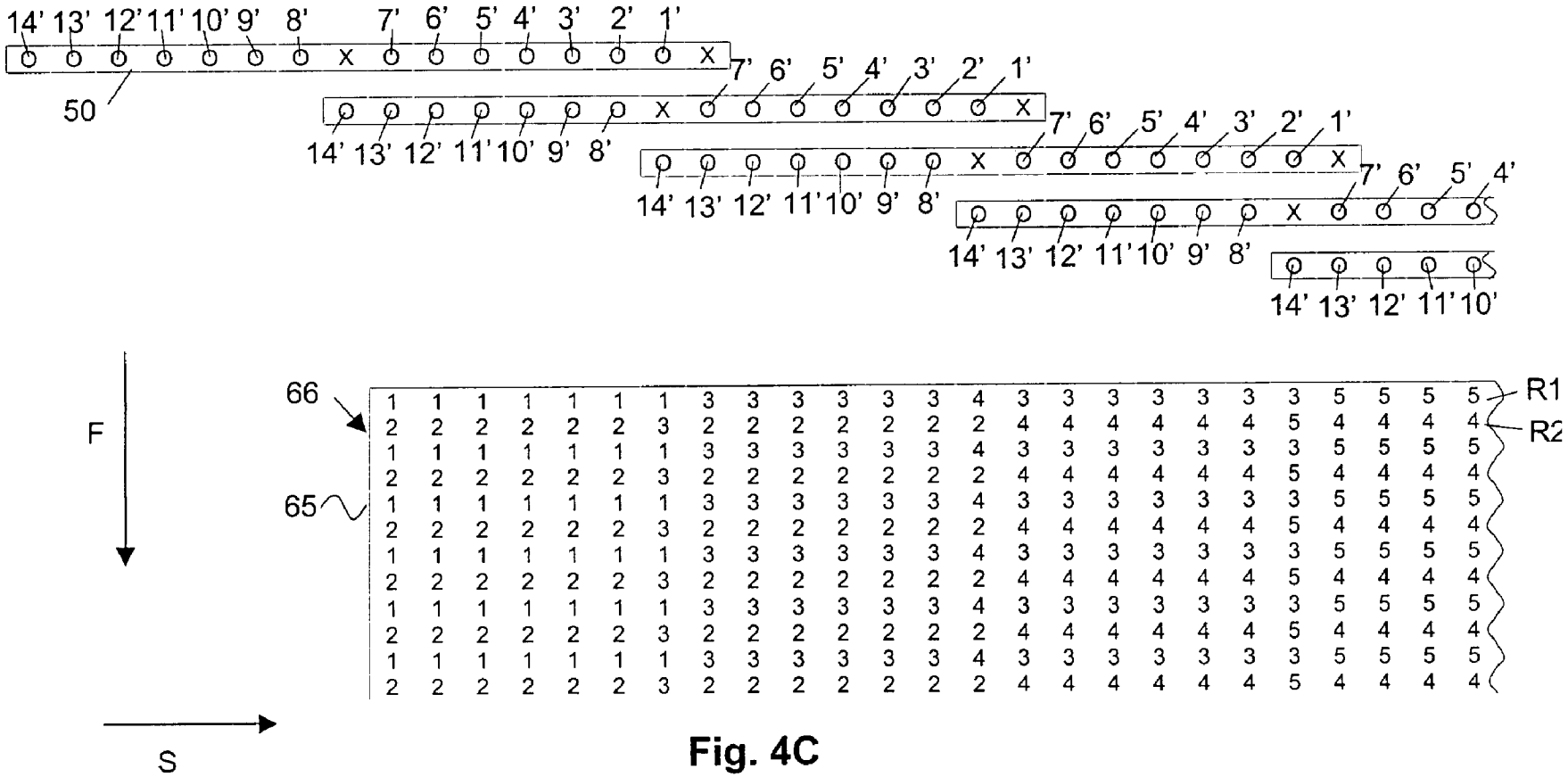
FIG. 4C illustrates the same embodiment as in FIG. 3, with the head being reconfigured according to a third embodiment so as to again have marking element redundancy of two as in FIG. 1.

Different configurations of the reconfigured print head 50 are shown in FIGS. 4A, 4B and 4C.

According to a first embodiment, illustrated in FIG. 4A, the print head 50 is reconfigured by making two marking elements inactive at a first side A of the print head 50. The number of marking elements made inactive when reconfiguring the print head 50 equals the number of redundant marking elements in a set, which is two for the example under consideration. In the present case, 14 marking elements 1'–14' remain active. The same redundancy as before reconfiguration of the print head 50 is kept (i.e. 2), so the 14 marking elements 1'–14' are now divided into groups of 7. Redundant pairs of marking elements now become (1', 8'), (2', 9'), (3', 10'), (4', 11'), (5', 12'), (6', 13') and (7', 14'). It can be seen that every pixel position can be reached by two different marking elements, which are different from the two equivalent marking elements which could reach that pixel position before reconfiguration of the print head 50. If one of the marking elements is defect, the corresponding equivalent marking element can take over its functioning.

During a first pass, marking elements 1'–7' should print on respective locations on odd rows starting with row R1. However, as marking element 7' is a defect one, locations 78 on odd rows will only be printed by equivalent marking element 14' during pass 2. During pass 2, marking element 7' should print on locations 80 on even rows starting with row R2, but due to the defect of marking element 7', dots on locations 80 are only printed (if needed in accordance with the image to be printed) by equivalent marking element 14' during the next pass.

According to a second embodiment or reconfiguration of the print head 50, illustrated in FIG. 4B, the print head 50 is reconfigured by making two marking elements inactive at a second side B of the print head 50. The number of marking elements made inactive when reconfiguring the print head 50 equals the number of redundant marking elements in a set, which is two for the example under consideration. In the present case, 14 marking elements 1'–14' remain active. The same redundancy as before reconfiguration of the print head 50 is kept (i.e. 2), so the 14 marking elements 1'–14' are now divided into groups of 7. Redundant pairs of marking elements now become (1', 8'), (2', 9'), (3', 10'), (4', 11'), (5', 12'), (6', 13') and (7', 14'). It can be seen that every pixel position can be reached by two different marking elements, which are different from the two equivalent marking elements which could reach that pixel position before reconfiguration of the print head 50. If one of the marking elements is defect, the corresponding equivalent marking element can take over its functioning.

During a first pass, marking elements 1'–7' should print on respective locations on odd rows starting with row R1. However, as marking element 1' is a defect one, locations 82 on odd rows will only be printed by equivalent marking element 8 during pass 2. During pass 2, marking element 9' should print on locations 84 on even rows starting with row R2, but due to the defect of marking element 9', dots on locations 84 have already been printed by equivalent marking element 2' during the previous pass.

According to a third embodiment, which is a special case that can only be carried out if the defect marking elements are at the beginning or end of each of the redundant groups of marking elements, the print head 50 is reconfigured by keeping the non-defect marking elements as active marking elements, and making the defective marking elements at the beginning or end of each of the redundant groups inactive. When reconfiguring the print head 50, the active marking elements 1'–14' are divided into redundant groups, while keeping the same redundancy as before reconfiguration of the print head 50. For the example under consideration, this means that the 14 active marking elements 1'–14' are now divided into two groups of 7 active marking elements. Every active marking element 1'–14' again has a redundant marking element. Redundant pairs of marking elements now become (1', 14'), (2', 8'), (3', 9'), (4', 10'), (5', 11'), (6', 12'), (7', 13'). Again every pixel position can be reached by two different marking elements, and if one of the marking elements is defective, the corresponding redundant marking element can take over its functioning.

Figure 5:
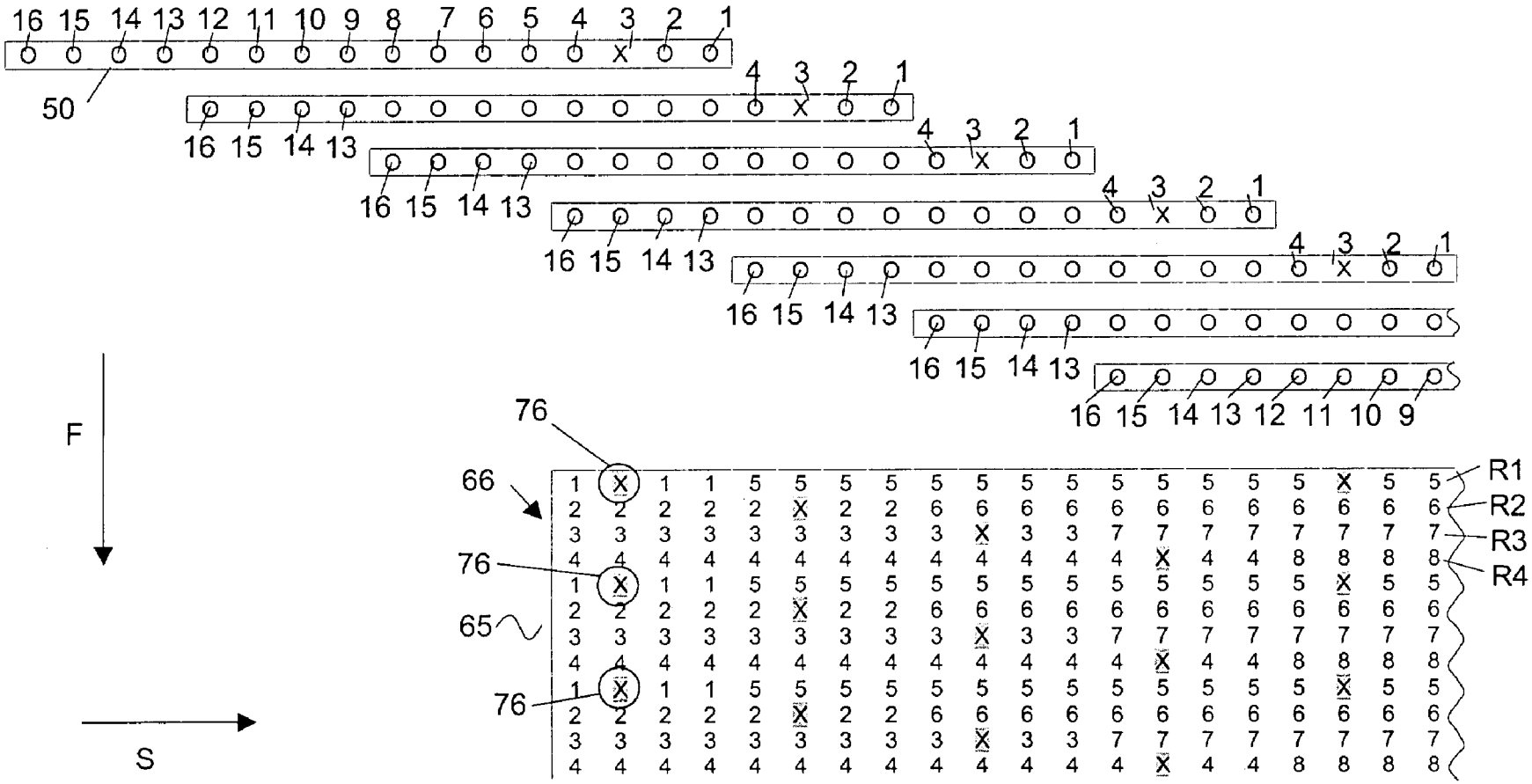
FIG. 5 shows an embodiment of a printing head with 16 marking elements used for 25% mutually interstitial printing, such that there is a marking element redundancy of four.

The same can be done with e.g. 25% mutually interstitial printing, as shown in FIG. 5. The cycling is as explained above for 50% mutually interstitial printing, except that the head 50 is now moved with respect to the print medium 66 over e.g. a quarter of its length between each pass. Each pixel location can be reached by 4 marking elements now, which form redundant sets of marking elements with a redundancy of 4. Redundant sets of marking elements are (1, 5, 9, 13), (2, 6, 10, 14), (3, 7, 11, 15), and (4, 8, 12, 16).

If one marking element breaks down or deviates from the desired printing location, for example marking element 3 as shown in FIG. 5, its function can be taken over by any of the marking elements 7, 11, or 15. This means that a pixel on pixel locations 76, which would normally be printed by marking element 3 during a first pass, may now either be printed by marking element 7 during the second pass, by marking element 11 during the third pass or by marking element 15 during the fourth pass. It can be easily seen that more marking elements may break down before a reconfiguration of the head 50 is necessary.

The choice of which marking element 7, 11, 15 is to be fired instead of a defect marking element 3 can be made based on different optimisation routines. This choice is made automatically. A test pattern is input into the printing device, either manually by a user or by a machine. The test pattern is printed, using the normal firing of the marking elements (i.e. redundant marking elements are fired alternatingly). Either the user or a machine detects whether the quality of the test results is OK. If not, the machine works out how to fix the problem. A new selection of marking elements is then made, e.g. depending on misalignment data.

According to a first embodiment, a possible optimisation routine is to relate every dot to its absolute position. Misalignment of marking elements, which is the deviation of a printed dot from its absolute position, can be characterised by a value showing the difference in location between where a dot should be and where it effectively arrives. If the misalignment of a marking element is below a certain threshold for all the marking elements of a redundant set (two marking elements in case of redundancy of 2, four marking elements in case of redundancy 4, etc.), then all marking elements are used alternatingly. If the misalignment for one marking element is below a certain threshold for a first marking element, and above a certain threshold for the other marking elements of the redundant set, then the first marking element is always used. If the misalignement for a first plurality of marking elements is below a certain threshold, and for other marking elements of the redundant set it is above the threshold, then the marking elements of the first plurality of marking elements are alternatingly used. If there are two marking elements in the redundant set, and the misalignment is in one direction for the first marking element, and in the other direction for the second marking element, then both marking elements are fired alternatingly.

If the misalignment is in the same direction for both marking elements, then the one with the lowest tolerance is always used. If one marking element is not working at all, then the other one is always used, independent of its misalignment.

According to a second embodiment, a possible optimising parameter is the interdot distance, whereby there is looked at neighbours of a dot. In a first step, all interdot distances are identified. Problem areas are identified, either manually or automatically. Then it is tried to minimise the interdot distance automatically.

If a pre-set number of marking elements from a redundant set of marking elements are defect, for example all the marking elements 3, 7, 11 and 15 of the redundant set of marking elements as in FIG. 5 are defect (or the relevant nozzles of any of the other FIGS. 1, 2, 3, 4A, 4B, 4C6A, 6B) then the print head 50 has to be reconfigured.

Figure 6A:
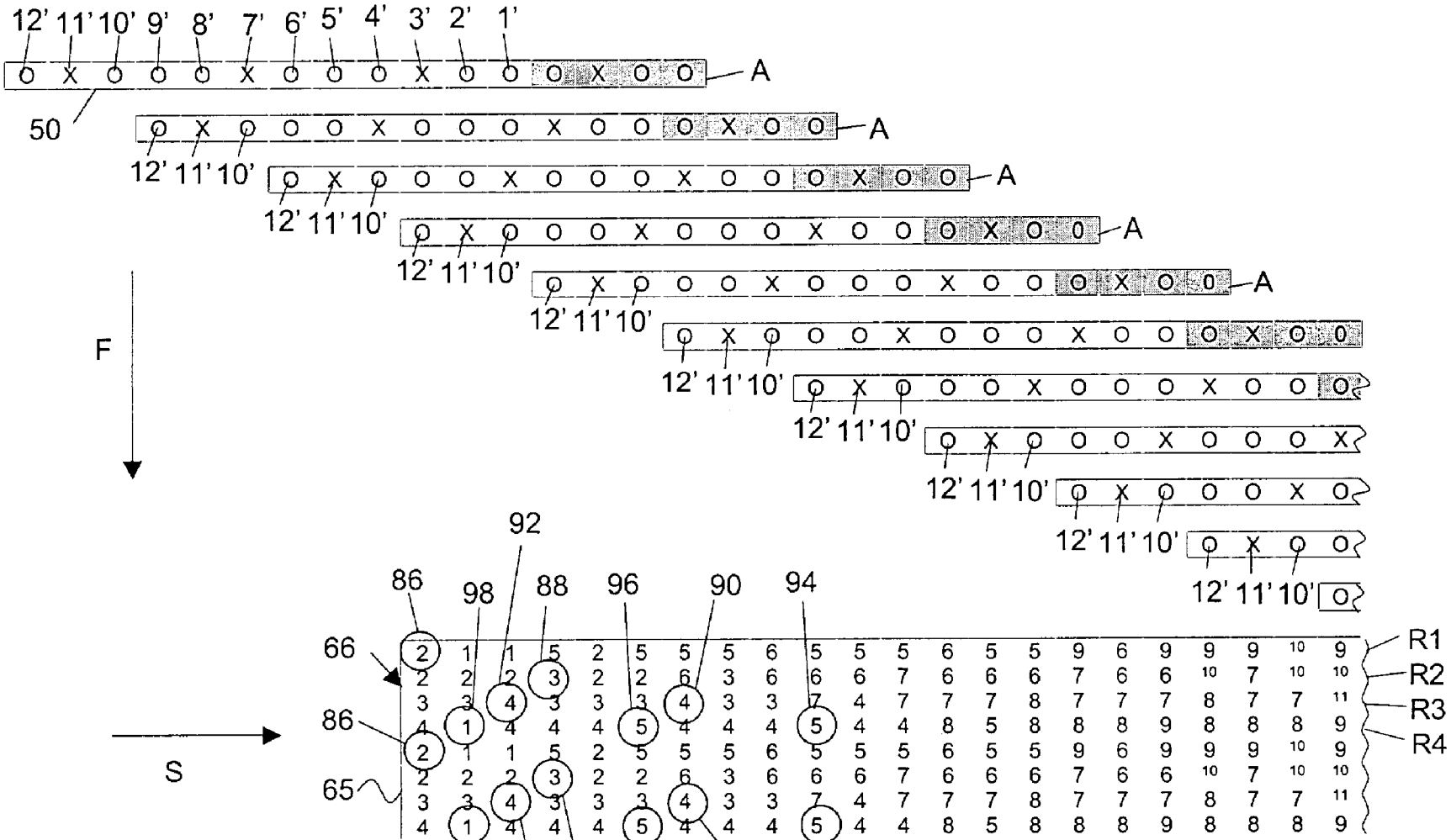
FIG. 6A illustrates the same embodiment as in FIG. 5, with the head being reconfigured according to a first embodiment so as to again have marking element redundancy of four as in FIG. 5.

According to a first embodiment, illustrated in FIG. 6A, the print head 50 is reconfigured by making a number of marking elements inactive at a first side A of the print head 50. The number of marking elements made inactive when reconfiguring the print head 50 equals the number of redundant marking elements in a set, which is four for the example under consideration. In the present case, 12 marking elements 1'–12' remain active. The same redundancy as before reconfiguration of the print head 50 is kept (i.e. 4), so the 12 marking elements 1'–12' are now divided into groups of 3. Redundant sets of marking elements now become (1', 4', 7', 10'), (2', 5', 8', 11'), and (3', 6', 9', 12'). It can be seen that every pixel position can be reached by four different marking elements, which are different from the four equivalent marking elements which could reach that pixel position before reconfiguration of the print head 50. If one of the marking elements is defect, a corresponding equivalent marking element can take over its functioning. In the example given, by reconfiguring the print head 50, the marking elements 3', 7' and 11' are still defective.

During a first pass, marking elements 1'–3' should print every fourth pixel in a column in the fast scan direction F, beginning with the first row R1. Locations where the print head 50 prints during the first pass are indicated by a 1 in matrix 65 of FIG. 6A. It is to be noted that, whether or not a marking element actually prints, depends on the image to be printed, i.e. whether or not a dot is to be printed at a certain location in the matrix 65. As marking element 3' is a defect one, locations 86 on every fourth row starting with row R1 will not be printed by marking element 3', but by one of the equivalent marking elements 6', 9' or 12' during one of the following passes. In the matrix 65 of FIG. 6A, dots are printed on locations 86 by equivalent marking elements 6' during pass 2. After the first pass, the print head 50 is displaced a quarter of its active marking element length (i.e. in the present case over three marking elements).

During pass 2, marking elements 1'–6' should print every fourth pixel in a column in the fast scan direction F, beginning with the second row R2. Locations where the print head 50 prints during the second pass are indicated by a 2 in matrix 65 of FIG. 6A. As marking element 3' is a defect one, locations 88 on every fourth row starting with row R2 will not be printed by marking element 3', but by one of the equivalent marking elements 6', 9' or 12' during one of the following passes. In the matrix 65 of FIG. 6A, dots are printed on locations 86 by equivalent marking elements 6' during pass 3. After the second pass, the print head 50 is displaced a quarter of its active marking element length again (i.e. in the present case over three marking elements).

During a third pass, marking elements 1'–9' should print every fourth pixel in a column in the fast scan direction F, beginning with the third row R3. Locations where the print head 50 prints during the third pass are indicated by a 3 in matrix 65 of FIG. 6A. As marking elements 3' and 7' are defect ones, locations 90 and 92 on every fourth row starting with row R3 will not be printed by respective marking elements 3' and 7'. Dots on locations 90 will be printed by one of the equivalent marking elements 6', 9' or 12' during one of the following passes (pass 4, pass 5 and pass 6 respectively). Dots on locations 92 will be printed either by equivalent marking elements 1' or 4' during one of the two previous passes, or by equivalent marking element 10' during the next pass. For example in the matrix 65 of FIG. 6A, dots are printed on locations 90 by equivalent marking element 6' during pass 4, and on locations 92 by equivalent marking element 10' during pass 4. After the third pass, the print head 50 is displaced a quarter of its active marking element length again.

During pass four, marking elements 1'–12' should print every fourth pixel in a column in the fast scan direction F, beginning with the fourth row R4. Locations where the print head 50 prints during the fourth pass are indicated by a 4 in matrix 65 of FIG. 6A. As marking elements 3', 7' and 11' are defect, locations 94, 96 and 98 on every fourth row starting with row R4 will not be printed by respective marking elements 3', 7' and 11'. Dots on locations 94 will be printed by one of the equivalent marking elements 6', 9' or 12' during one of the following passes (pass 5, pass 6 or pass 7 respectively). Dots on locations 96 will be printed either by equivalent marking elements 1' or 4' during one of the two previous passes, or by equivalent marking element 10' during the next pass. Dots on locations 98 will be printed by one of the equivalent marking elements 2', 5' or 8' during one of the three previous passes. For example in the matrix 65 of FIG. 6A, dots are printed on locations 94 by equivalent marking element 6' during pass 5, on locations 96 by equivalent marking element 10' during pass 5, and on locations 98 by equivalent marking element 2' during pass 1. After the fourth pass, the print head 50 is displaced a quarter of its active marking element length again.

Such cycles comprising moving the print head 50 over a quarter of its length, starting to print at the first row R1, moving the head 50 over a quarter of its length, starting to print at the second row R2, moving the print head 50 over a quarter of its length, starting to print at the third row R3, moving the head 50 over a quarter of its length, and starting to print at the fourth row R4, are repeated continuously.

Figure 6B:
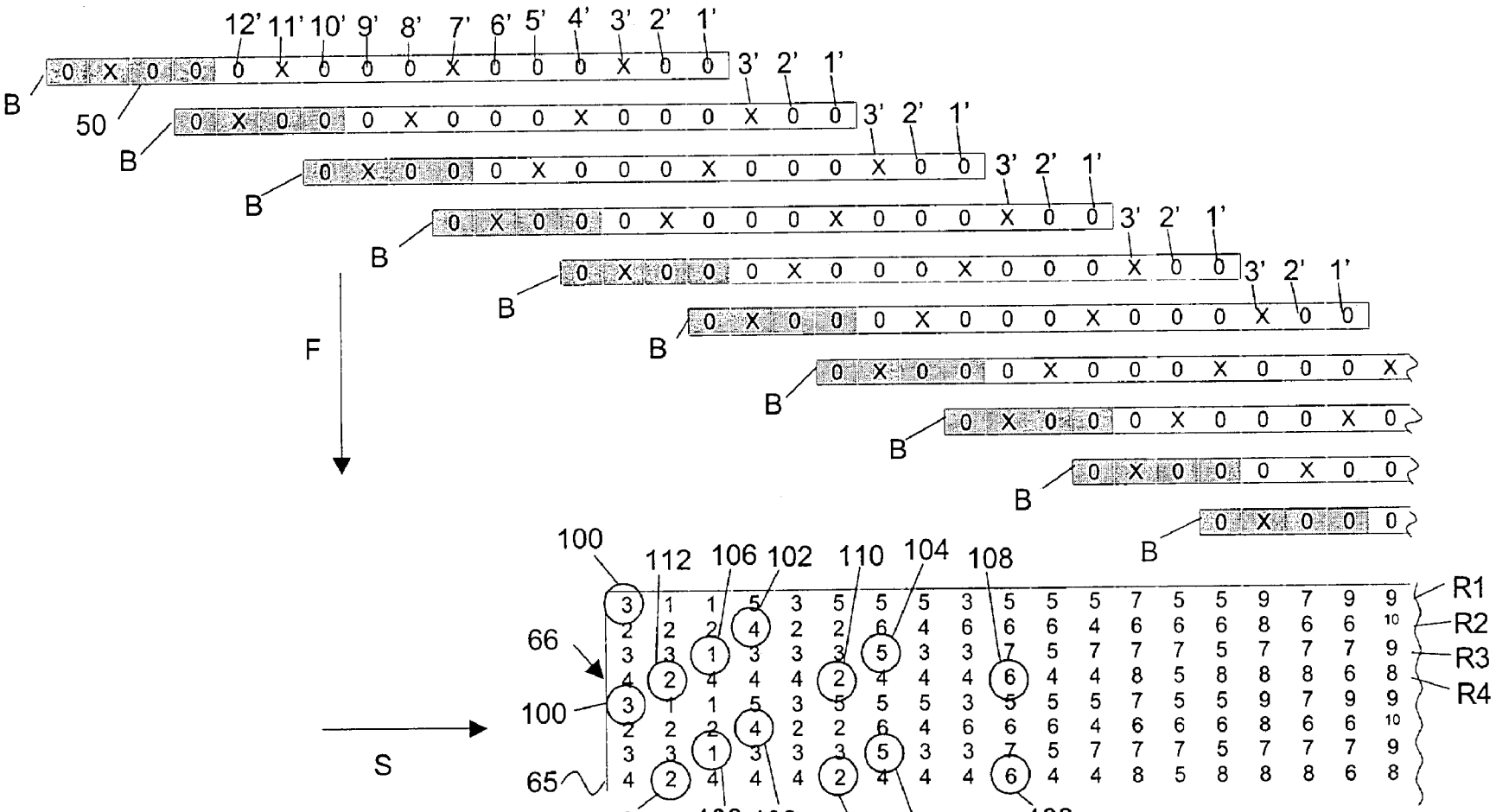
FIG. 6B illustrates the same embodiment as in FIG. 5, with the head being reconfigured according to a second embodiment so as to again have marking element redundancy of four as in FIG. 5.

According to a second embodiment, illustrated in FIG. 6B, the print head 50 is reconfigured by making a number of marking elements inactive at a second side B of the print head 50. The number of marking elements made inactive when reconfiguring the print head 50 equals the number of redundant marking elements in a set, which is four for the example under consideration. In the present case, 12 marking elements 1'–12' remain active. The same redundancy as before reconfiguration of the print head 50 is kept (i.e. 4), so the 12 marking elements 1'–12' are now divided into groups of 3. Redundant sets of marking elements now become (1', 4', 7', 10'), (2', 5', 8', 11'), and (3', 6', 9', 12'). It can be seen that every pixel position can be reached by four different marking elements, which are different from the four equivalent marking elements which could reach that pixel position before reconfiguration of the print head 50. If one of the marking elements is defect, a corresponding equivalent marking element can take over its functioning. In the example given, by reconfiguring the print head 50, the marking elements 3', 7' and 11' are still defective.

During a first pass, marking elements 1'–3' should print every fourth pixel in a column in the fast scan direction F, beginning with the first row R1. Locations where the print head 50 prints during the first pass are indicated by a 1 in matrix 65 of FIG. 6B. It is to be noted that, whether or not a marking element actually prints, depends on the image to be printed, i.e. whether or not a dot is to be printed at a certain location in the matrix 65. As marking element 3' is a defect one, locations 100 on every fourth row starting with row R1 will not be printed by marking element 3', but by one of the equivalent marking elements 6', 9' or 12' during one of the following passes. In the matrix 65 of FIG. 6A, dots are printed on locations 100 by equivalent marking elements 9' during pass 3. After the first pass, the print head 50 is displaced a quarter of its active marking element length (i.e. in the present case over three marking elements).

During pass 2, marking elements 1'–6' should print every fourth pixel in a column in the fast scan direction F, beginning with the second row R2. Locations where the print head 50 prints during the second pass are indicated by a 2 in matrix 65 of FIG. 6A. As marking element 3' is a defect one, locations 102 on every fourth row starting with row R2 will not be printed by marking element 3', but by one of the equivalent marking elements 6', 9' or 12' during one of the following passes 3, 4 or 5 respectively. In the matrix 65 of FIG. 6A, dots are printed on locations 102 by equivalent marking elements 9' during pass 4. After the second pass, the print head 50 is displaced a quarter of its active marking element length again (i.e. in the present case over three marking elements).

During a third pass, marking elements 1'–9' should print every fourth pixel in a column in the fast scan direction F, beginning with the third row R3. Locations where the print head 50 prints during the third pass are indicated by a 3 in matrix 65 of FIG. 6A. As marking elements 3' and 7' are defect ones, locations 104 and 106 on every fourth row starting with row R3 will not be printed by respective marking elements 3' and 7'. Dots on locations 104 will be printed by one of the equivalent marking elements 6', 9' or 12' during one of the following passes (pass 4, pass 5 or pass 6 respectively). Dots on locations 106 will be printed either by equivalent marking elements 1' or 4' during one of the two previous passes, or by equivalent marking element 10' during the next pass. For example in the matrix 65 of FIG. 6B, dots are printed on locations 104 by equivalent marking element 9' during pass 5, and on locations 106 by equivalent marking element 1' during pass 1. After the third pass, the print head 50 is displaced a quarter of its active marking element length again.

During pass four, marking elements 1'–12' should print every fourth pixel in a column in the fast scan direction F, beginning with the fourth row R4. Locations where the print head 50 prints during the fourth pass are indicated by a 4 in matrix 65 of FIG. 6B. As marking elements 3', 7' and 11' are defect, locations 108, 110 and 112 on every fourth row starting with row R4 will not be printed by respective marking elements 3', 7' and 11'. Dots on locations 108 will be printed by one of the equivalent marking elements 6', 9' or 12' during one of the following passes (pass 5, pass 6 or pass 7 respectively). Dots on locations 110 will be printed either by equivalent marking elements 1' or 4' during one of the two previous passes, or by equivalent marking element 10' during the next pass. Dots on locations 112 will be printed by one of the equivalent marking elements 2', 5' or 8' during one of the three previous passes. For example in the matrix 65 of FIG. 6B, dots are printed on locations 108 by equivalent marking element 9' during pass 6, on locations 110 by equivalent marking element 1' during pass 2, and on locations 112 by equivalent marking element 5' during pass 2. After the fourth pass, the print head 50 is displaced a quarter of its active marking element length again.

Such cycles comprising moving the print head 50 over a quarter of its length, starting to print at the first row R1, moving the head 50 over a quarter of its length, starting to print at the second row R2, moving the print head 50 over a quarter of its length, starting to print at the third row R3, moving the head 50 over a quarter of its length, and starting to print at the fourth row R4, are repeated continuously.

Figure 7:
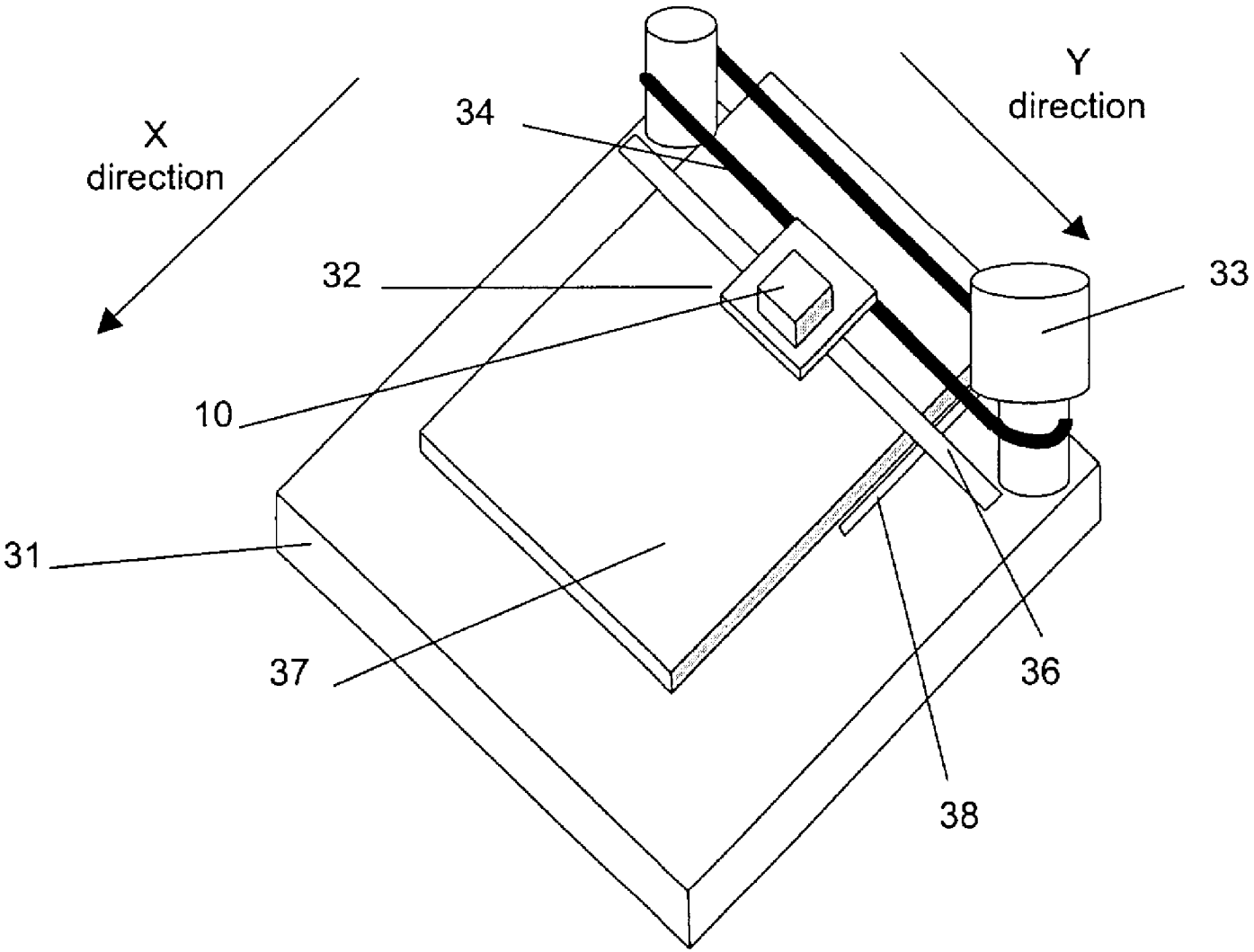
FIG. 7 is a highly schematic representation of an inkjet printer for use with the present invention.

FIG. 7 is a highly schematic general perspective view of an inkjet printer 20 which can be used with the present invention. The printer 20 includes a base 31, a carriage assembly 32, a step motor 33, a drive belt 34 driven by the step motor 33, and a guide rail assembly 36 for the carriage assembly 32. Mounted on the carriage assembly 32 is a print head 10 that has a plurality of nozzles. The print head 10 may also include one or more ink cartridges or any suitable ink supply system. A sheet of paper 37 is fed in the slow scan direction over a support 38 by a feed mechanism (not shown). The carriage assembly 32 is moved along the guide rail assembly 36 by the action of the drive belt 34 driven by the step motor 33 in the fast scanning direction.

Figure 8:
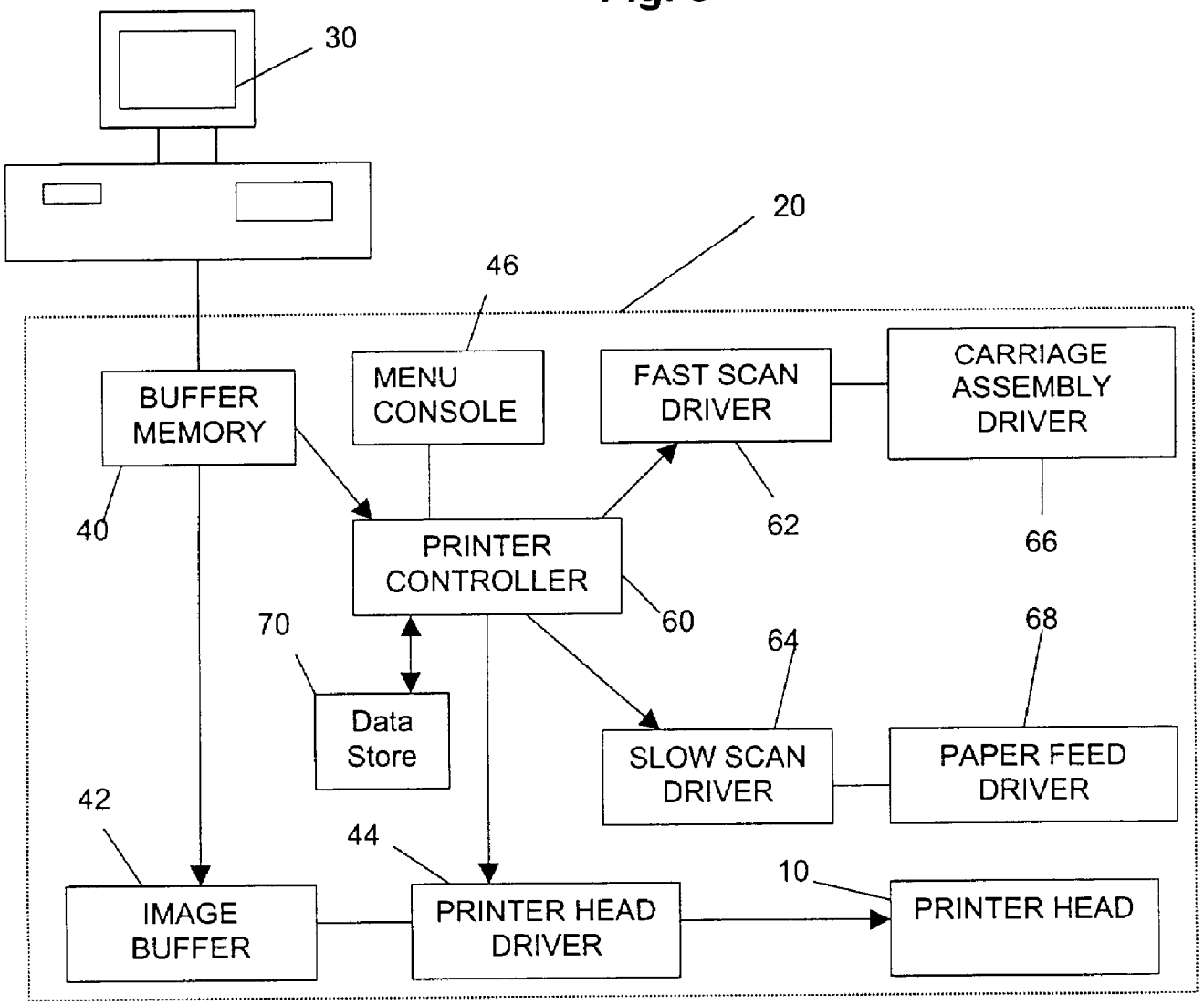
FIG. 8 is a schematic representation of a printer controller in accordance with an embodiment of the present invention.

FIG. 8 is a block diagram of the electronic control system of a printer 20, which is one example of a control system for use with a print head 10 in accordance with the present invention. The printer 20 includes a buffer memory 40 for receiving a print file in the form of signals from a host computer 30, an image buffer 42 for storing printing data, and a printer controller 60 that controls the overall operation of the printer 10. Connected to the printer controller 60 are a fast scan driver 62 for a carriage assembly drive motor 66, a slow scan driver 64 for a paper feed drive motor 68, and a head driver 44 for the print head 10. Optionally, there is a data store 70 for storing parameters for controlling the printing operation in accordance with the present invention. Host computer 30 may be any suitable programmable computing device such as personal computer with a Pentium III microprocessor supplied by Intel Corp. USA, for instance, with memory and a graphical interface such as Windows 98 as supplied by Microsoft Corp. USA. The printer controller 60 may include a computing device, e.g. microprocessor, for instance it may be a microcontroller. In particular, it may include a programmable printer controller, for instance a programmable digital logic element such as a Programmable Array Logic (PAL), a Programmable Logic Array, a Programmable Gate Array, especially a Field Programmable Gate Array (FPGA). The use of an FPGA allows subsequent programming of the printer device, e.g. by downloading the required settings of the FPGA.

The user of printer 20 can optionally set values into the data store 70 so as to modify the operation of the printer head 10. The user can for instance set values into the data store 70 by means of a menu console 46 on the printer 20. Alternatively, these parameters may be set into the data store 70 from host computer 30, e.g. by manual entry via a keyboard. For example, based on data specified and entered by the user, a printer driver (not shown) of the host computer 30 determines the various parameters that define the printing operations and transfers these to the printer controller 60 for writing into the data store 70, e.g. the resolution. One aspect of the present invention is that the printer controller 60 controls the operation of printer head 10 in accordance with settable parameters stored in data store 70. Based on these parameters, the printer controller reads the required information contained in the printing data stored in the buffer memory 40 and sends control signals to the drivers 62, 64 and 44. In particular controller 60 is adapted for a dot matrix printer for printing an image on a printing medium, the control unit comprising, software or hardware means for controlling printing of the image, and software or hardware means for providing alternative marker element firing schemes in order to compensate for defective marker elements in accordance with methods of the present invention. In accordance with the present invention the controller 60 is adapted to drive the head driver 44 in such a way that defective marker elements are replaced by other marker elements.

For instance, the printing data is broken down into the individual colour components to obtain image data in the form of a bit map for each colour component which is stored in the receive buffer memory 30. In accordance with control signals from the printer controller 60, the head driver 44 reads out the colour component image data from the image buffer memory 52 to drive the speed and the array(s) of nozzles on the print head 10 to achieve the required resolution. As indicated above the controller 60 may be programmable, e.g. it may include a microprocessor or an FPGA. In accordance with embodiments of the present invention a printer in accordance with the present invention may be programmed to provide different defective marker element schemes. For example, the basic model of the printer may not have any marker element replacement scheme. An upgrade in the form of a program to download into the microprocessor or FPGA of the controller 60 may provide additional defective marker functionality, e.g. a method of defective marker compensation in accordance with the present invention. Accordingly, the present invention includes a computer program product which provides the functionality of any of the methods according to the present invention when executed on a computing device. Further, the present invention includes a data carrier such as a CD-ROM or a diskette which stores the computer product in a machine readable form and which executes at least one of the methods of the invention when executed on a computing device. Nowadays, such software is often offered on the Internet or a company Intranet for download, hence the present invention includes transmitting the printing computer product according to the present invention over a local or wide area network. The computing device may include one of a microprocessor and an FPGA.

The data store 70 may comprise any suitable device for storing digital data as known to the skilled person, e.g. a register or set of registers, a memory device such as PAM, EPROM or solid state memory.

While the invention has been shown and described with reference to a preferred embodiment, it will be understood by those skilled in the art that various changes or modifications in form and detail may be made without departing from the scope and spirit of this invention. For instance, the preparation for the printing file to carry out the above mentioned printed embodiments may be prepared by the host computer 30 and the printer 20 simply prints in accordance with this file as a slave device of the host computer 30. Hence, the present invention includes that the printing schemes of the present invention are implemented in software on a host computer and printed on a printer which carries out the instructions from the host computer without amendment. Accordingly, the present invention includes a computer program product which provides the functionality of any of the methods according to the present invention when executed on a computing device which is associated with a printing head, that is the printing head and the programmable computing device may be included with the printer or the programmable device may be a computer or computer system, e.g. a Local Area Network connected to a printer. The printer may be a network printer. Further, the present invention includes a data carrier such as a CD-ROM or a diskette which stores the computer product in a machine readable form and which can execute at least one of the methods of the invention when the program stored on the data carrier is executed on a computing device. The computing device may include a personal computer or a work station. Nowadays, such software is often offered on the Internet or a company Intranet for download, hence the present invention includes transmitting the printing computer product according to the present invention over a local or wide area network.

The invention claimed is:

1. A dot matrix printing method for printing a dot matrix on a printing medium using a plurality of marking elements on a printing head, comprising the steps of determining a set of combinations of firing order of the plurality of marking elements and a sequence of relative translation movements between the printing medium and the printing head, each said combination representing a distinct firing order and sequence, so that all the dots in the dot matrix are printed, and any dot in the dot matrix is printed by at least a first or a second equivalent marking element from a set of equivalent marking elements, selecting, for printing sets of dots in the dot matrix, a first equivalent marking element from the set of equivalent marking elements to print the set of dots as part of a first firing order, if a pre-set number of equivalent marking elements of the set of equivalent marking elements are defective, reconfiguring the printing head so that another set of combinations of firing order of the plurality of marking elements is determined as well as another sequence of relative translation movements between the printing medium and the printing head so that all the dots in the dot matrix are printed, and any dot in the dot matrix is printed by at least a new first or a second equivalent marking element from the new set of equivalent marking elements.

2. A method according to claim 1, wherein the first or second equivalent marking elements are fired as part of a mutually interstitial printing scheme.

3. A method according to claim 1, wherein the selecting step is based on misalignment of the marking elements.

4. A method according to claim 3, wherein, if misalignment is below a threshold for all equivalent marking elements, the equivalent marking elements are fired alternatingly.

5. A method according to claim 3, wherein, if misalignment is below a threshold for a first number of equivalent marking elements, and above that threshold for the other equivalent marking elements, then the first number of marking elements are fired alternatingly.

6. A method according to claim 3, wherein, if misalignment for a first number of equivalent marking elements is in one direction, and misalignment of the other equivalent marking elements is in the opposite direction, then for each direction the equivalent marking element with the lowest misalignment value is determined, and these equivalent marking elements are fired alternatingly.

7. A method according to claim 3, wherein, if nozzle misalignment is in the same direction for all equivalent marking elements, the marking element with the lowest misalignment value is always fired.

8. A method according to any of claim 1, wherein the selecting step is based on interdot distance of dots printed by the marking elements.

9. A method according to claim 8, wherein an equivalent marking element is not used if the distance of a dot printed by this marking element to its neighbouring dots is larger than a predetermined threshold.

10. A method according to claim 1, wherein the printing times for printing by means of the first equivalent marking element or by means of the second equivalent marking element are the same.

11. A method according to claim 1, wherein the reconfiguration step is done in software.

12. A computer program product for executing the method as claimed in claim 1 when executed on a computing device associated with a printing head.

13. A machine readable data storage device storing the computer program product of claim 12.

14. An apparatus for dot matrix printing an image on a printing medium, comprising:

a printing head, a plurality of equally spaced marking elements on the printing head, a determination device to determine a set of combinations of firing order of the plurality of equally spaced marking elements and a sequence of relative translation movements between the printing head and the printing medium, each said combination representing a distinct firing order and sequence, so that all dots in the dot matrix are printed, and any dot in the matrix is printed by one of at least two equivalent marking elements of a set of equivalent marking elements, a selecting device for selecting, for printing sets of dots in the dot matrix, a first equivalent marking element of the set of equivalent marking elements to print the set of dots as a part of a first firing order, and a reconfiguration device for reconfiguring the printing head if a pre-set number of equivalent marking elements of the set of equivalent marking elements are defective, so that other sets of at least first and second equivalent marking elements are determined by the determination device determining a new set of combinations of firing order as well as new sequence of relative translation movements between the printing head and the printing medium.

15. The apparatus according to claim 14, wherein the marking elements are ink projecting nozzles.

16. The apparatus according to claim 15, the apparatus being adapted so that printing times for printing by means of the first equivalent marking element or by means of the second equivalent marking element are the same.

17. The apparatus according to claim 14, wherein the reconfiguration device is implemented in software.

18. An ink jet printing device including an apparatus according to claim 14.

19. A control unit for a printer for printing an image on a printing medium using a print head with a plurality of equally spaced marking elements, the control unit being adapted to control the determination of a set of combinations of firing order of the plurality of equally spaced marking elements and a sequence of relative translation movements between the printing head and the printing medium, each said combination representing a distinct firing order and sequence, so that all dots in a dot matrix are printed and any dot in the matrix is printed by at least a first or a second equivalent marking element from a set of equivalent marking elements, and the control unit is adapted to control the selection, in order to print sets of dots in the dot matrix, of a first equivalent marking element of the set of equivalent marking elements to print the set of dots as a part of a first firing order, and to control a reconfiguration of the printing head if a pre-set number of equivalent marking elements of the set of equivalent marking elements are defective, so that another set of combinations of firing order of the plurality of marking elements is determined as well as a new sequence of relative translation movements between the printing medium and the printing head so that all the dots in the dot matrix are printed and any dot in the dot matrix is printed by at least a new first or a second equivalent marking element from the new set of equivalent marking elements.

* * * * *